US009956672B2

(12) United States Patent
Shimizu et al.

(10) Patent No.: US 9,956,672 B2
(45) Date of Patent: May 1, 2018

(54) SCREW TIGHTENING TOOL

(71) Applicant: BROTHER KOGYO KABUSHIKI KAISHA, Nagoya-shi, Aichi-ken (JP)

(72) Inventors: Akie Shimizu, Nagoya (JP); Nobuhiko Funato, Gifu (JP); Hideyuki Takahashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 440 days.

(21) Appl. No.: 14/682,489

(22) Filed: Apr. 9, 2015

(65) Prior Publication Data

US 2015/0306750 A1 Oct. 29, 2015

(30) Foreign Application Priority Data

Apr. 25, 2014 (JP) ..... 2014-090804

(51) Int. Cl.

| | |
|---|---|
| ***B25B 23/00*** | (2006.01) |
| ***B25B 23/08*** | (2006.01) |
| ***B25B 15/00*** | (2006.01) |
| ***B25B 15/02*** | (2006.01) |
| ***B25B 15/04*** | (2006.01) |

(52) U.S. Cl.

CPC ..... *B25B 23/0028* (2013.01); *B25B 15/00* (2013.01); *B25B 15/008* (2013.01); *B25B 15/02* (2013.01); *B25B 15/04* (2013.01); *B25B 23/08* (2013.01)

(58) Field of Classification Search

CPC ... B25B 23/0028; B25B 23/005; B25B 15/02; B25F 1/04; B26B 11/00

See application file for complete search history.

(56) References Cited

U.S. PATENT DOCUMENTS 234,540 A * 11/1880 Collins ..... B25B 13/48 7/138
4,512,693 A * 4/1985 Swanson ..... B23B 51/00 279/14

(Continued)

FOREIGN PATENT DOCUMENTS

JP S55-160776 U 11/1980

OTHER PUBLICATIONS

Feb. 20, 2018 Office Action issued in Japanese Patent Application No. 2014-090804.

*Primary Examiner* — Christopher M Koehler
*Assistant Examiner* — Seahee Yoon
(74) *Attorney, Agent, or Firm* — Oliff PLC

(57) ABSTRACT

A screw tightening tool includes a case body, a tool member, and a switching portion. The case body includes a guide portion configured such that a head portion of a screw is inserted therein. The tool member includes an engaging portion including a bit portion configured to engage with the head portion. The switching portion supports the tool member. The switching portion is configured to switch a position of the tool member among a first position, a second position, and a third position. The first position is a position in which the bit portion protrudes to an outside from the case body. The second position is a position in which the bit portion protrudes to the outside from the case body and that is different from the first position. The third position is a position in which the case body houses the bit portion.

5 Claims, 7 Drawing Sheets

(56) References Cited

U.S. PATENT DOCUMENTS

| | | | | |
|---|---|---|---|---|
| 4,590,824 | A * | 5/1986 | Cushman | B25B 15/02 81/28 |
| 5,069,091 | A * | 12/1991 | Bramsiepe | B25B 15/02 81/177.5 |
| 5,146,815 | A * | 9/1992 | Scott, III | B25B 27/0071 81/437 |
| 5,553,340 | A | 9/1996 | Brown, Jr. | |
| 6,308,599 | B1 | 10/2001 | Fu-Hui | |
| 6,397,709 | B1 * | 6/2002 | Wall | B25B 15/00 81/177.4 |
| 7,249,543 | B1 * | 7/2007 | Pomerantz | B25B 15/00 7/165 |
| D687,285 | S * | 8/2013 | Thomas | D8/85 |
| 8,621,963 | B2 * | 1/2014 | Johnson | B25B 13/461 81/177.5 |
| 2002/0005095 | A1 * | 1/2002 | Anderson | B25F 1/003 81/440 |
| 2002/0069729 | A1 | 6/2002 | Anderson et al. | |
| 2003/0226430 | A1 * | 12/2003 | Casel | B25G 1/066 81/490 |
| 2004/0246707 | A1 * | 12/2004 | Miyamoto | B25B 13/56 362/119 |
| 2008/0127785 | A1 * | 6/2008 | Sun | G09F 3/00 81/468 |
| 2009/0223329 | A1 * | 9/2009 | Hi | B25G 1/066 81/177.8 |
| 2010/0116104 | A1 * | 5/2010 | Hung | B25G 1/085 81/490 |
| 2011/0000025 | A1 * | 1/2011 | Johnson | B25B 15/00 7/118 |
| 2012/0137445 | A1 | 6/2012 | Arvinte et al. | |

* cited by examiner

SCREW TIGHTENING TOOL

CROSS-REFERENCE TO RELATED APPLICATION

This application claims priority to Japanese Patent Application No. 2014-090804 filed Apr. 25, 2014, the content of which is hereby incorporated herein by reference.

BACKGROUND

The present disclosure relates to a screw tightening tool.

A screw tightening tool is provided in which a base end of a tool member is rotatably provided on one end of a main body case. The tool member is configured to adjust an angle of the tool member with respect to the main body case by the tool member rotating around its base end. More specifically, the tool member can be switched among a housed position, a first protruding position, and a second protruding position. The housed position is a position in which the main body case houses the tool member. The first protruding position is a position in which the tool member protrudes from the main body case in a direction orthogonal to an extending direction of the main body case. The second protruding position is a position in which the tool member protrudes from the main body case in the extending direction of the main body case. A user may switch the position of the tool member between the first protruding position and the second protruding position in accordance with a position of a screw. The user may engage a bit portion, which is attached to a leading end of the tool member, with a head portion of the screw. The user may grip the main body case and rotate the screw tightening tool. In this way, the user may tighten or loosen the screw using the screw tightening tool.

SUMMARY

When the user tightens or loosens the screw, the user normally needs to rotate the screw a plurality of times. Since the user releases and regrips a case body, the user may need to temporarily release the user's hand from the screw tightening tool. In this case, there is a possibility that the screw tightening tool may become disengaged from the head portion of the screw.

Embodiments of the broad principles derived herein provide a screw tightening tool that is capable of switching a position of a tool member that is configured to engage with a head portion of a screw and that allows easy releasing and regripping by a user when the user tightens or loosens the screw.

Embodiments provide a screw tightening tool that includes a case body, a tool member, and a switching portion. The case body includes a guide portion. The guide portion is configured such that a head portion of a screw is inserted therein. The tool member includes an engaging portion. The engaging portion includes a bit portion that is configured to engage with the head portion. The switching portion supports the tool member. The switching portion is configured to switch a position of the tool member among a first position, a second position, and a third position. The first position is a position in which the bit portion protrudes to an outside from the case body. The second position is a position in which the bit portion protrudes to the outside from the case body and that is different from the first position. The third position is a position in which the case body houses the bit portion. The bit portion is configured to, in the third position, engage with the head portion inserted in the guide portion.

BRIEF DESCRIPTION OF THE DRAWINGS

Embodiments will be described below in detail with reference to the accompanying drawings in which.

DETAILED DESCRIPTION

Figure 1:
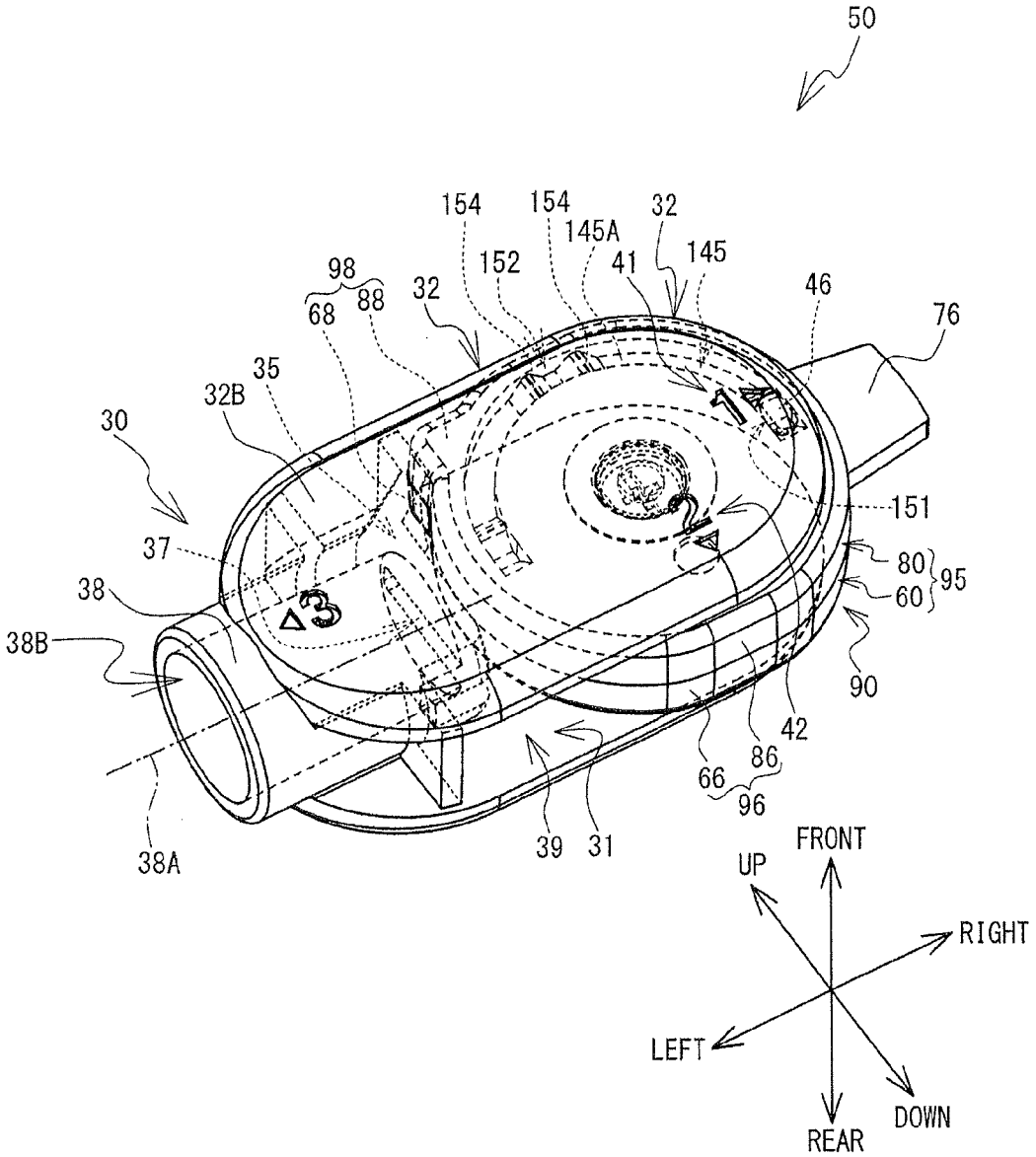
FIG. 1 is a perspective view of a screw tightening tool 50 when a tool member 90 is in a first position.

A screw tightening tool 50 according to an embodiment will be described with reference to the appended drawings. For convenience of explanation, an upper side, a lower side, an upper right side, a lower left side, an upper left side, and a lower right side in FIG. 1 respectively correspond to a front side, a rear side, a right side, a left side, an upper side, and a lower side of the screw tightening tool 50.

A structure of the screw tightening tool 50 will be described with reference to FIG. 1 to FIG. 3. The screw tightening tool 50 includes a case body 30 and a tool member 90. The case body 30 has a substantially flat elliptical shape that is long in the left-right direction. The tool member 90 is supported rotatably about an axis inside the case body 30. The tool member 90 includes a bit portion 76. The bit portion 76 may engage with a groove portion of a head portion of a screw (not shown in the drawings). A user may switch a position of the bit portion 76 among a first position (refer to FIG. 1), a second position (refer to FIG. 4), and a third position (refer to FIG. 5) by rotating the tool member 90. Thus, the user may switch the position of the bit portion 76 in accordance with a position of the screw, etc.

A structure of the case body 30 will be described with reference to FIG. 1 and FIG. 2. The case body 30 is made of a synthetic resin material, for example. The case body 30 includes a pair of side wall portions 31 and 32, a bridge portion 35, and a guide portion 38. The pair of side wall portions 31 and 32 are each a plate-like body having a substantially flat elliptical shape in a front view and an extending direction of the side wall portions 31 and 32 is the left-right direction. The pair of side wall portions 31 and 32 are opposed to each other in the front-rear direction with a specified gap being between the pair of side wall portions 31 and 32. The side wall portion 31 is arranged on a rear side of the side wall portion 32. The case body 30 is made of a synthetic resin material. Thus, the side wall portions 31 and 32 have an appropriate level of flexibility and can elastically deform to some extent.

Figure 2:
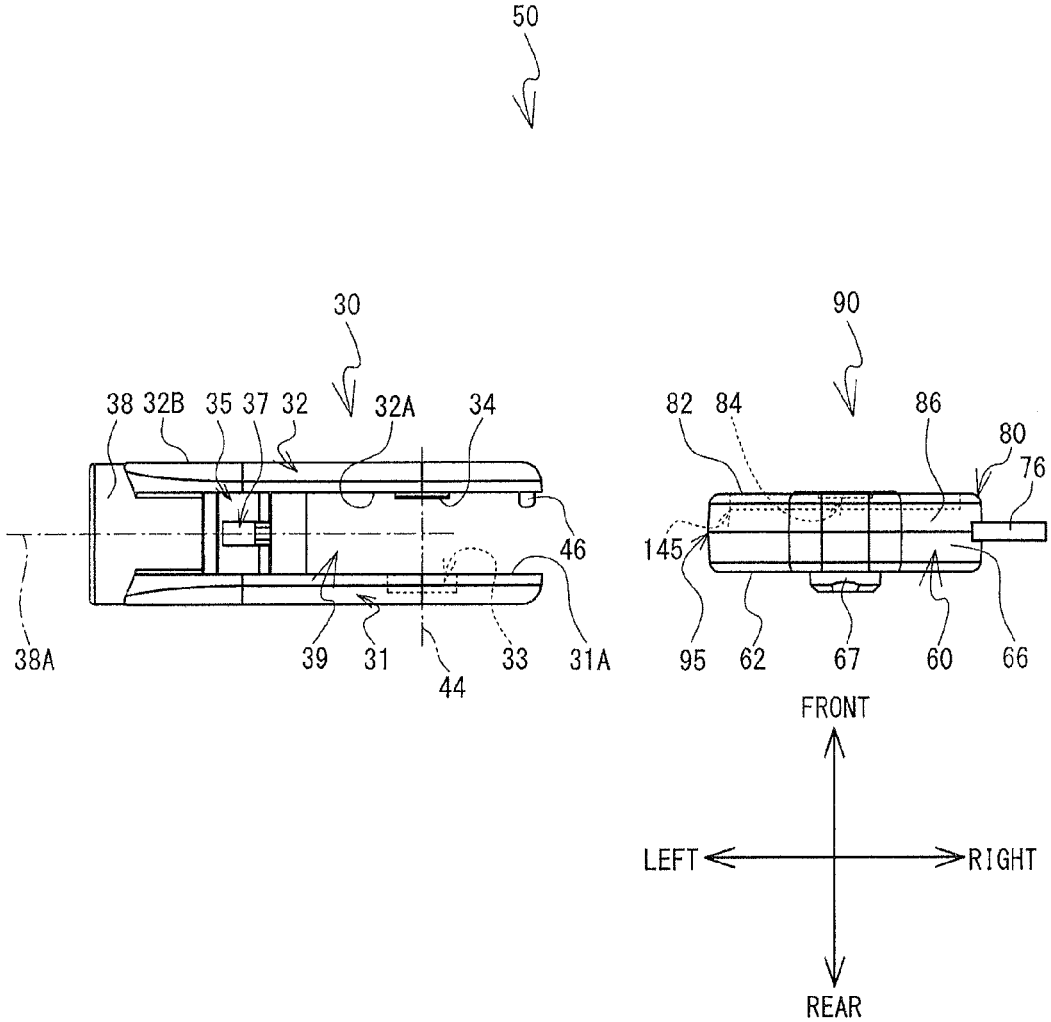
FIG. 2 is a diagram in which the screw tightening tool 50 is disassembled into a case body 30 and the tool member 90.
Figure 3:
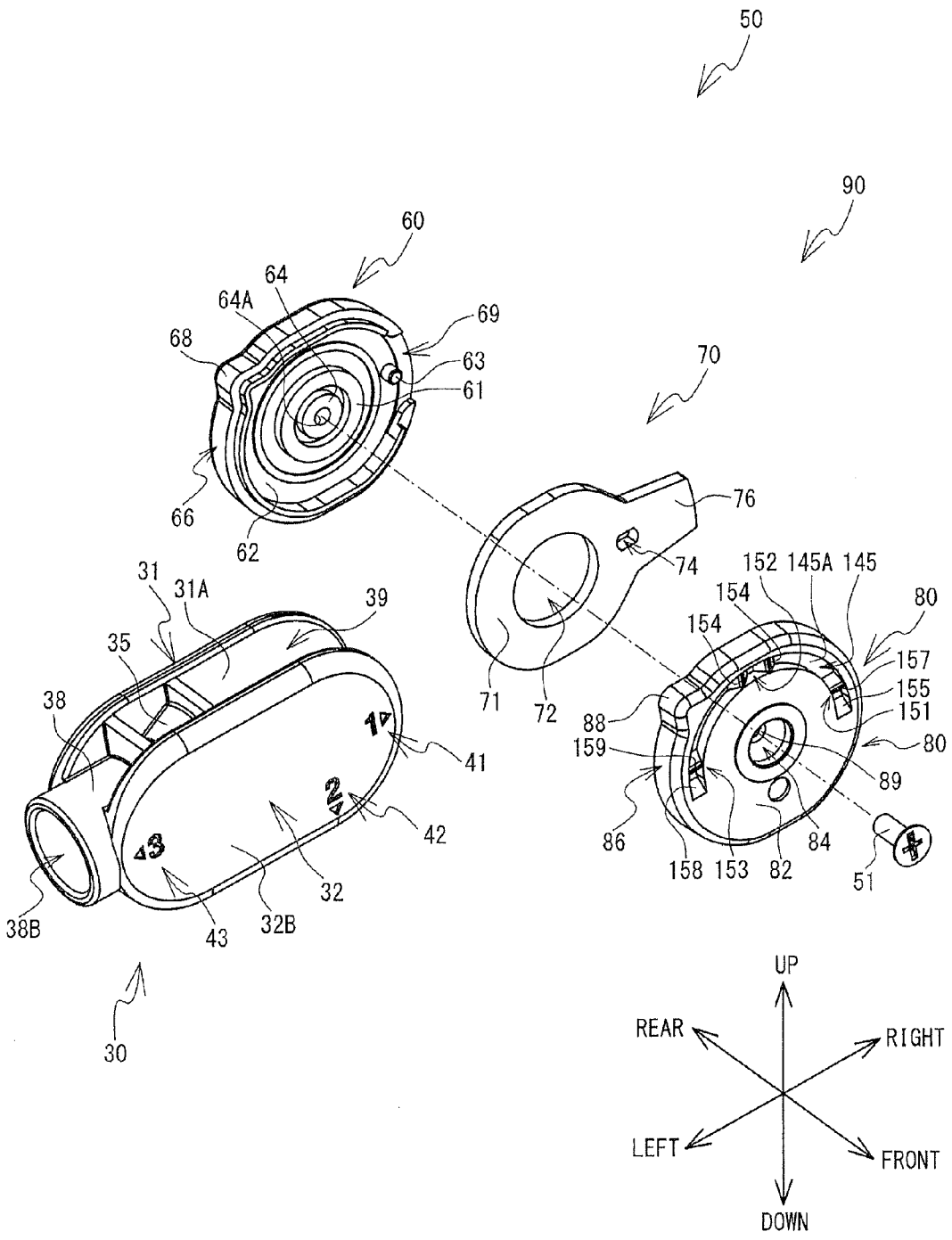
FIG. 3 is an exploded perspective view of the screw tightening tool 50.

The side wall portion 31 has a recessed portion 33, as shown in FIG. 2. The recessed portion 33 is provided in a right side portion of a front surface 31A of the side wall portion 31. The recessed portion 33 has a substantially circular shape in a front view. The side wall portion 32 has a convex portion 34 and a locking portion 46. The convex portion 34 is disposed to the front of the recessed portion 33. The convex portion 34 is formed in a cylindrical shape that protrudes to the rear from a rear surface 32A of the side wall portion 32. A center line of the convex portion 34 matches up with a center line of the recessed portion 33. Hereinafter, the center line of the convex portion 34 and the concave portion 33 will be referred to as a center line 44. The locking portion 46 is formed in an elliptic cylindrical shape that protrudes to the rear from the rear surface 32A on a right side of the convex portion 34. A leading end of the locking portion 46 is formed into a curved surface.

The bridge portion 35 is formed in a plate-like shape that is long in the upper-lower direction, as shown in FIG. 1. The bridge portion 35 bridges between the side wall portions 31 and 32. The bridge portion 35 has a notch portion 37 at a lower end portion thereof. The notch portion 37 is a portion that is recessed upward from a lower surface of the bridge portion 35. The guide portion 38 is formed in a cylindrical shape that extends in the leftward direction from the bridge portion 35. The guide portion 38 protrudes further to the left than left ends of the side wall portions 31 and 32. A cylindrical hole 38B is formed inside the guide portion 38. A center line 38A (refer to FIG. 1 and FIG. 2) of the guide portion 38 (the cylindrical hole 38B) extends in the left-right direction and is orthogonal to the center line 44 (refer to FIG. 2). The guide portion 38 is integrally formed with the bridge portion 35 and the pair of side wall portions 31 and 32. A right end portion of the guide portion 38 is connected with the lower end portion of the bridge portion 35. An internal diameter of the cylindrical hole 38B is slightly larger than an external diameter of a head portion of an embroidery frame screw 18, which will be described below. Thus, the head portion of the embroidery frame screw 18 may be inserted into the cylindrical hole 38B.

A structure of the tool member 90 will be described with reference to FIG. 1 and FIG. 3. A gap 39 is provided between the side wall portions 31 and 32 on a right side of the bridge portion 35. The tool member 90 is arranged in the gap 39. The case body 30 rotatably supports the tool member 90. The tool member 90 includes a base portion 95 and an engaging portion 70 (refer to FIG. 3). The base portion 95 is formed in a substantially circular shape in a front view and supports the engaging portion 70. The base portion 95 is made of a synthetic resin material, for example.

The base portion 95 has a first base portion 60 and a second base portion 80. The first base portion 60 is positioned to the rear of the base portion 95 and the second base portion 80 is positioned to the front of the base portion 95. The first base portion 60 includes a surface portion 62 and a peripheral wall portion 66, as shown in FIG. 3. The surface portion 62 is formed in a circular shape in a front view. An annular portion 61 is provided in a substantially central section on a front surface of the surface portion 62. The annular portion 61 is formed in an annular shape that protrudes to the front. A boss 64 is provided inside the annular portion 61 arranged on the front surface of the surface portion 62. The boss 64 has a screw hole 64A. A boss 63 is provided on an outer side of the annular portion 61. A convex portion 67 (refer to FIG. 2) is provided in a central section on a rear surface of the surface portion 62. The convex portion 67 is formed in a cylindrical shape and protrudes to the rear from the rear surface of the surface portion 62. The convex portion 67 fits into the concave portion 33 (refer to FIG. 2).

The peripheral wall portion 66 protrudes to the front from a peripheral portion of the surface portion 62. The peripheral wall portion 66 has an opening 69 on a side on which the boss 63 is arranged with respect to the annular portion 61 (to the right of the screw tightening tool 50 in FIG. 3). A convex portion 68 is formed in a part of the peripheral wall portion 66 on a section opposite to the opening 69 with respect to the annular portion 61. The convex portion 68 protrudes from the peripheral wall portion 66 in a direction in which the convex portion 68 is separated from the annular portion 61.

The second base portion 80 includes a surface portion 82 and a peripheral wall portion 86. The surface portion 82 has the same shape as that of the surface portion 62. The peripheral wall portion 86 protrudes to the rear from a peripheral portion of the surface portion 82. A convex portion 88 is formed in the peripheral wall portion 86. The convex portion 88 protrudes in a direction in which the convex portion 88 is separated from a central section of the surface portion 82. The convex portion 88 is arranged in front of the convex portion 68.

The surface portion 82 includes a concave portion 84, which has a substantially circular shape in a front view, in a central section on the front surface of the surface portion 82. The convex portion 34 (refer to FIG. 2) of the side wall portion 32 fits into the concave portion 84. A round hole 89 is provided on a wall portion arranged at a rearmost section of the concave portion 84. The round hole 89 penetrates through the surface portion 82 in the front-rear direction. A screw 51 is inserted into the round hole 89. A screw portion of the screw 51 is screwed into the screw hole 64A of the first base portion 60. As a result, the second base portion 80 is fixed to the first base portion 60. The first base portion 60 and the second base portion 80 fix the engaging portion 70 (refer to FIG. 3) by sandwiching the engaging portion 70 from the front and rear. The peripheral wall portions 66 and 86 form a peripheral wall portion 96 (refer to FIG. 1) by abutting against each other. The convex portions 68 and 88 form a convex portion 98 (refer to FIG. 1) by abutting against each other. The convex portion 98 protrudes to the outside from the peripheral wall portion 96.

The engaging portion 70 is formed in a flat plate-shape having a thickness in the front-rear direction. The engaging portion 70 is made of a metal material, for example. The engaging portion 70 includes a supported portion 71 and the bit portion 76. The supported portion 71 is formed in a substantially annular shape in a front view and is arranged inside the peripheral wall portion 96 (refer to FIG. 1). The supported portion 71 includes a round hole 72 and a long hole 74. The round hole 72 penetrates through the supported portion 71 in the front-rear direction. The long hole 74 penetrates through the supported portion 71 in the front-rear direction. As a result of the annular portion 61 being inserted into the round hole 72 and the boss 63 being inserted into the long hole 74, the first base portion 60 supports and fixes the supported portion 71.

The bit portion 76 is a part that extends to the outside from the supported portion 71 and is formed in a substantially rectangular shape in a front view. Of the engaging portion 70, the bit portion 76 forms an end portion on a side on which the long hole 74 is arranged with respect to the round hole 72. The bit portion 76 protrudes from the opening 69 to the outside of the base portion 95 (refer to FIG. 1). The bit portion 76 is configured to engage with the groove portion of the head portion of the screw. More specifically, the bit portion 76 forms a leading end portion of the engaging portion 70. The supported portion 71 forms a base end portion of the engaging portion 70.

A groove portion 145 will be described with reference to FIG. 2 and FIG. 3. The groove portion 145 is provided in the front surface of the surface portion 82. The groove portion 145 is a recessed section in the front surface of the surface portion 82. The groove portion 145 extends along the peripheral portion of the surface portion 82 forming a substantially semicircular arc-shape. Both end portions of the groove portion 145 in an extending direction thereof are arranged at symmetrical positions with respect to the recessed portion 84. The locking portion 46 (refer to FIG. 2) is inserted into the groove portion 145 from the front. A depth (a width in the front-rear direction) of the groove portion 145 is slightly longer than a protrusion length (a length in the front-rear direction) of the locking portion 46. A first lock portion 151, a second lock portion 152, and a third lock portion 153 are provided in the groove portion 145.

The first lock portion 151 is provided in a right end portion of the groove portion 145 in the extending direction. The first lock portion 151 includes a first inclined portion 155 and a protruding portion 157. The first inclined portion 155 is a wall portion disposed at a right end edge of the groove portion 145 in the extending direction. The first inclined portion 155 inclines in an extending direction of the groove portion 145 such that the first inclined portion 155 extends toward the front from a groove bottom 145A of the groove portion 145. The protruding portion 157 protrudes to the front from the groove bottom 145A. The protruding portion 157 is formed so as to taper as the protruding portion 157 extends further to the front. The locking portion 46 may be locked between the first inclined portion 155 and the protruding portion 157. In this way, the locking portion 46 may be locked at the first lock portion 151 (refer to FIG. 1).

The second lock portion 152 is provided in a substantially central section of the groove portion 145 in the extending direction. The second lock portion 152 includes two protruding portions 154 that are arranged side by side in the extending direction of the groove portion 145. A shape of the protruding portion 154 is the same as that of the protruding portion 157. The locking portion 46 may be locked between the two protruding portions 154. In this way, the locking portion 46 may be locked at the second lock portion 152 (refer to FIG. 4).

The third lock portion 153 is provided in a left end portion of the groove portion 145 in the extending direction. The third lock portion 153 is arranged on the opposite side to the first lock portion 151 with respect to the recessed portion 84 of the surface portion 82. The third lock portion 153 includes a second inclined portion 158 and a protruding portion 159. The second inclined portion 158 is a wall portion disposed at a left end edge of the groove portion 145 in the extending direction. The second inclined portion 158 inclines in the extending direction of the groove portion 145 such that the second inclined portion 158 extends toward the front from the groove bottom 145A of the groove portion 145. A shape of the protruding portion 159 is the same as that of the protruding portion 157. The locking portion 46 may be locked between the second inclined portion 158 and the protruding portion 159. In this way, the locking portion 46 may be locked at the third lock portion 153 (refer to FIG. 5).

A method for assembling the tool member 90 to the case body 30 will be described. More specifically, the tool member 90 may be arranged at the right of the case body 30, as shown in FIG. 2. The tool member 90 may be assembled to the case body 30 by moving the tool member 90 in the left direction from the right of the case body 30. At this time, the side wall portion 31 and the side wall portion 32 of the case body 30 may elastically deform in a direction in which the side wall portion 31 and the side wall portion 32 are separated from each other. As a result, the convex 67 may be fitted into the recessed portion 33, and the recessed portion 84 may be fitted into the convex portion 34. The tool member 90 may be moved in the left direction up to an assembly completion position. The assembly completion position is a position in which the locking portion 46 engages with the first lock portion 151. When the tool member 90 reaches the assembly completion position, the elastic deformation of the side wall portion 31 and the side wall portion 32 may return to the original state. When the assembly is completed, the tool member 90 does not come off from the case body 30. After the assembly is completed, the tool member 90 may be rotated around the center line 44.

A positional relationship between the tool member 90 and the case body 30 will be described with reference to FIG. 1, FIG. 2, FIG. 4, and FIG. 5. In accordance with a situation of use of the screw tightening tool 50, the user may switch a rotation position of the tool member 90. Namely, the user may switch a position of the bit portion 76 among the first position, the second position, and the third position. When the tool member 90 is in the first position, the first lock portion 151 locks the locking portion 46. When the tool member 90 is in the second position, the second lock portion 152 locks the locking portion 46. When the tool member 90 is in the third position, the third lock portion 153 locks the locking portion 46.

When the tool member 90 is in the first position, the bit portion 76 of the engaging portion 70 protrudes to the right from a right end portion of the case body 30, as shown in FIG. 1. In this case, the case body 30 houses the convex portion 98 and the convex portion 98 is in contact with an upper side portion of the bridge portion 35. As a result, the screw tightening tool 50 regulates a rotation of the tool member 90 in the counterclockwise direction in a front view (hereinafter referred to as a reverse rotational direction). The first lock portion 151 locks the locking portion 46. Therefore, the tool member 90 does not rotate in the clockwise direction in a front view (hereinafter referred to as a normal rotational direction) even when a relatively weak force is applied to the tool member 90. That is, when the tool member 90 is in the first position, the tool member 90 does not freely rotate in the normal rotational direction. Therefore, when the user switches the position of the tool member 90, the user may rotate the tool member 90 in the normal rotational direction by applying an appropriate amount of force to the tool member 90. In this case, the side wall portion 32 may elastically deform to an appropriate extent, and the locking portion 46 may slide over the protruding portion 157 of the first lock portion 151. Thus, the locked state between the locking portion 46 and the first lock portion 151 may be released.

Figure 4:
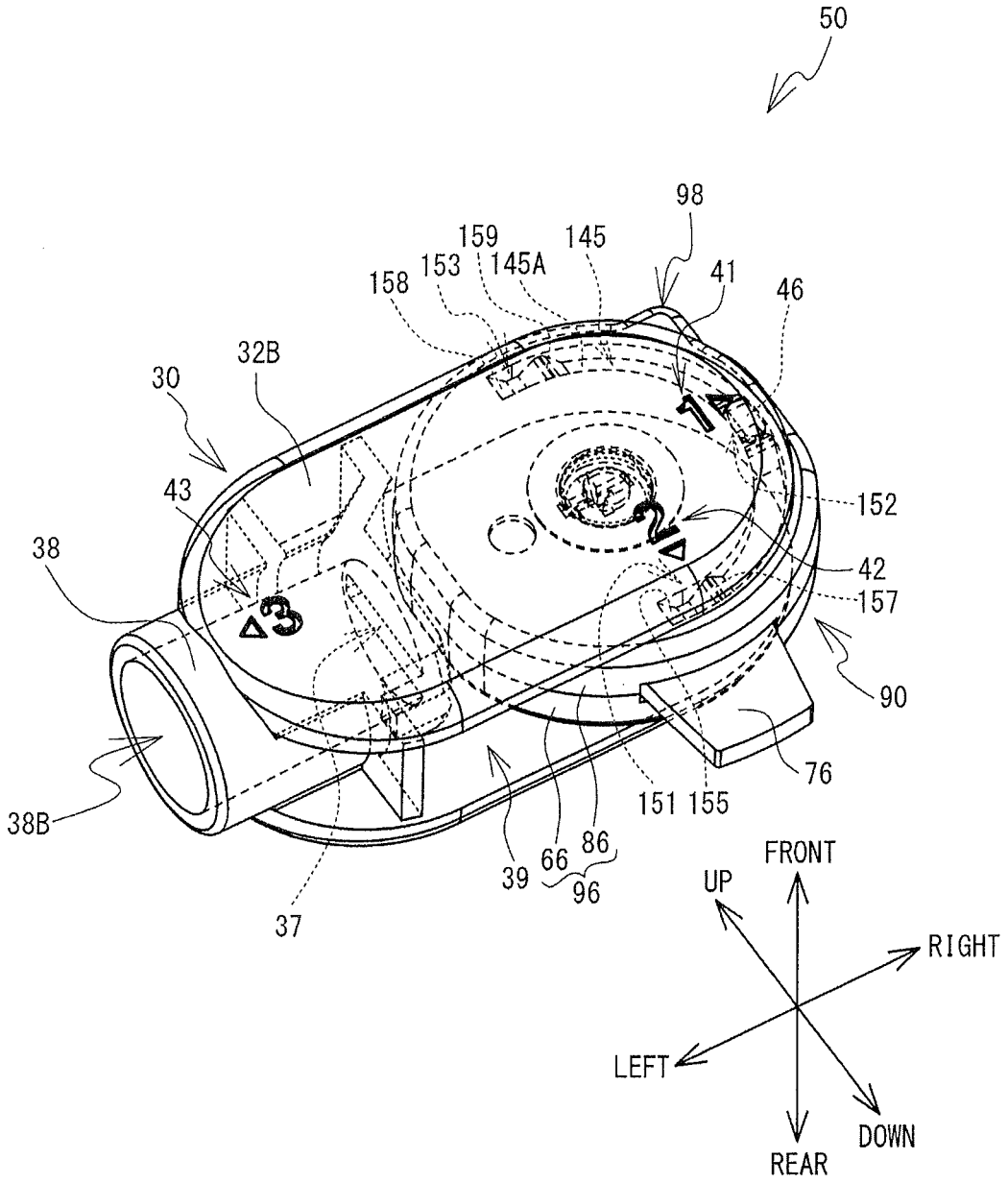
FIG. 4 is a perspective view of the screw tightening tool 50 when the tool member 90 is in a second position.

When the tool member 90 is in the second position, the bit portion 76 protrudes downward from a lower end portion of the case body 30, as shown in FIG. 4. At this time, the bit portion 76 is positioned further to the right than a substantially central position of the case body 30 in the left-right direction. The convex portion 98 is positioned so as to protrude to the outside from an upper right portion of the case body 30. The second lock portion 152 locks the locking portion 46. Therefore, the tool member 90 does not rotate either in the normal rotational direction or in the reverse rotational direction even when a relatively weak force is applied to the tool member 90. That is, the tool member 90 does not freely rotate. Therefore, when the user switches the position of the tool member 90 from the second position, the user may rotate the tool member 90 one of in the normal rotational direction and in the reverse rotational direction by applying an appropriate amount of force to the tool member 90. In this case, the side wall portion 32 may elastically deform to an appropriate extent, and the locking portion 46 may slide over one of the protruding portions 154 of the second lock portion 152. Thus, the locked state between the locking portion 46 and the first lock portion 152 may be released.

Figure 5:
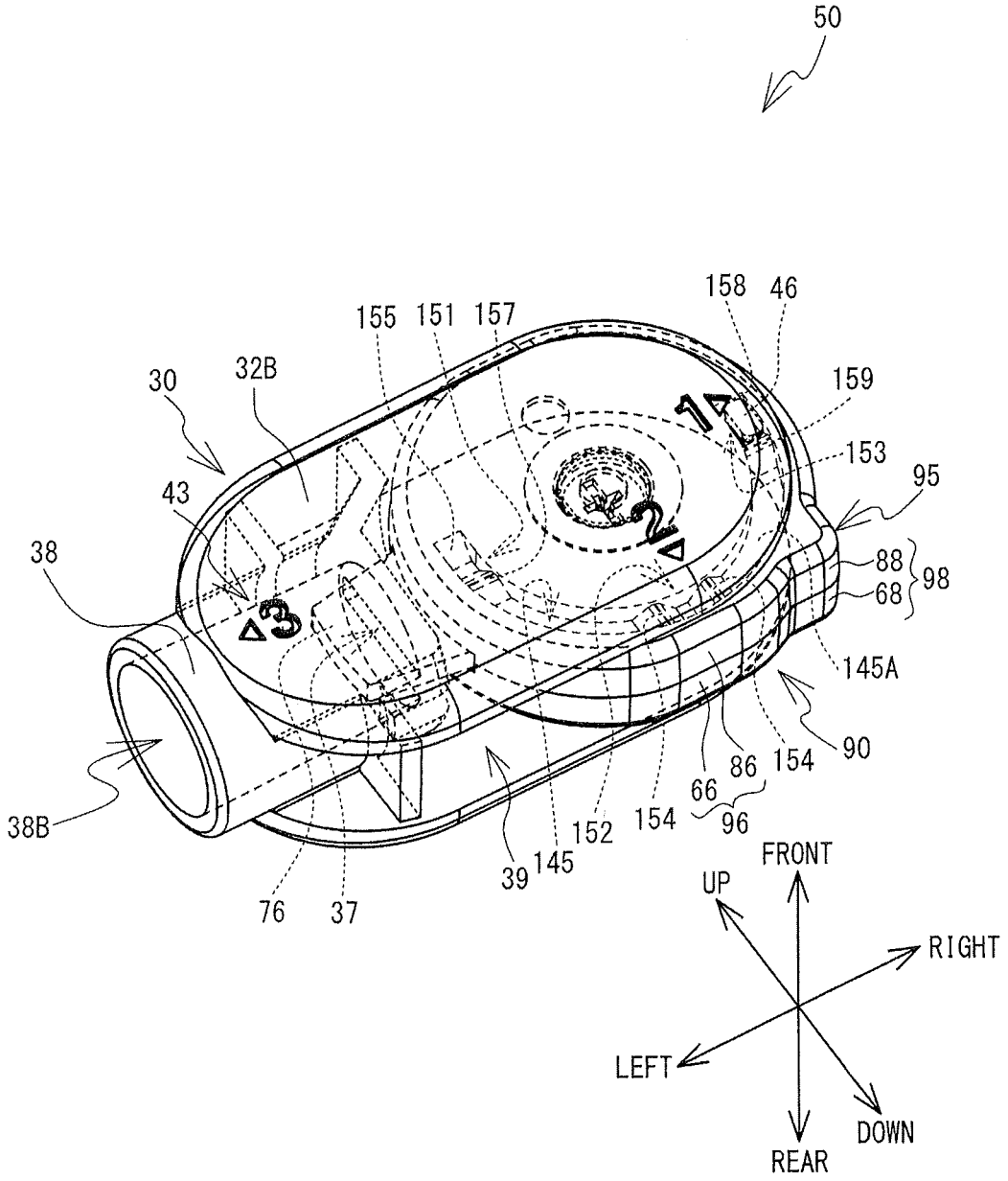
FIG. 5 is a perspective view of the screw tightening tool 50 when the tool member 90 is in a third position.

When the tool member 90 is in the third position, the case body 30 houses the bit portion 76, as shown in FIG. 5. The bit portion 76 has passed through the notch portion 37 and is positioned inside the cylindrical hole 38B. The bit portion 76 is in contact with an upper end portion of the notch portion 37. As a result, the screw tightening tool 50 regulates the rotation of the tool member 90 in the normal rotational direction. The third lock portion 153 locks the locking portion 46. Thus, the tool member 90 does not rotate in the reverse rotational direction even when a relatively weak force is applied to the tool member 90. When the tool member 90 is in the third position, the tool member 90 does not freely rotate in the reverse rotational direction. Therefore, when the user switches the position of the tool member 90, the user may rotate the tool member 90 to rotate in the reverse rotational direction by applying an appropriate amount of force to the tool member 90. In this case, the convex portion 98 is positioned so as to protrude to the outside from a lower right portion of the case body 30. Thus, the user may easily rotate the tool member 90 by hooking the convex portion 98 with the user's finger tip. As a result, the side wall portion 32 may elastically deform to an appropriate extent, and the locking portion 46 may slide over the protruding portion 159 of the third lock portion 153. Then, the locked state between the locking portion 46 and the third lock portion 153 may be released.

A first mark portion 41, a second mark portion 42, and a third mark portion 43 will be described with reference to FIG. 1, FIG. 4, and FIG. 5. The first mark portion 41, the second mark portion 42, and the third mark portion 43 are formed in a recessed shape respectively at a right end portion, a lower end portion, and a left end portion of a front surface 32B of the side wall portion 32. The first mark portion 41 is arranged at substantially the same position as that of the bit portion 76 positioned in the first position in a rotational direction of the tool member 90, as shown in FIG. 1. The first mark portion 41 displays a numerical character "1" and a triangle. One of apexes of the triangle of the first mark portion 41 points to the bit portion 76 positioned in the first position. In this way, the first mark portion 41 indicates the first position of the tool member 90.

The second mark portion 42 is arranged at substantially the same position as that of the bit portion 76 positioned in the second position in the rotational direction of the tool member 90, as shown in FIG. 4. The second mark portion 42 displays a numerical character "2" and a triangle. One of apexes of the triangle of the second mark portion 42 points to the bit portion 76 positioned in the second position. In this way, the second mark portion 42 indicates the second position of the tool member 90.

The third mark portion 43 is arranged at substantially the same position as that of the bit portion 76 positioned in the third position in the rotational direction of the tool member 90, as shown in FIG. 5. The third mark portion 43 displays a numerical character "3" and a triangle. The triangle of the third mark portion 43 points to the left in the same manner as the bit portion 76 positioned in the third position. In this way, the third mark portion 43 indicates the third position of the tool member 90. As described above, when the user rotates the tool member 90, the user may easily identify the first, second, and third positions by visually recognizing the first mark portion 41, the second mark portion 42, and the third mark portion 43.

A method for using the screw tightening tool 50 will be described with reference to FIG. 1 and FIG. 4 to FIG. 7. The screw tightening tool 50 is used on a sewing machine 10 shown in FIG. 6, for example. The sewing machine 10 includes an embroidery unit 8. The embroidery unit 8 may be removably attached to a bed 1 of the sewing machine 10. The sewing machine 10, the bed 1, and the embroidery unit 8 respectively have a known configuration. Thus, a detailed description of the sewing machine 10, the bed 1, and the embroidery unit 8 is omitted herein. The sewing machine 10 includes a plurality of screws. The following description will be made to describe a method for using the screw tightening tool 50 to tighten or loosen each of a presser foot screw 23, a needle plate screw 7, and the embroidery frame screw 18 of the sewing machine 10. It is assumed that the tool member 90 is in the first position before using the screw tightening tool 50.

Figure 6:
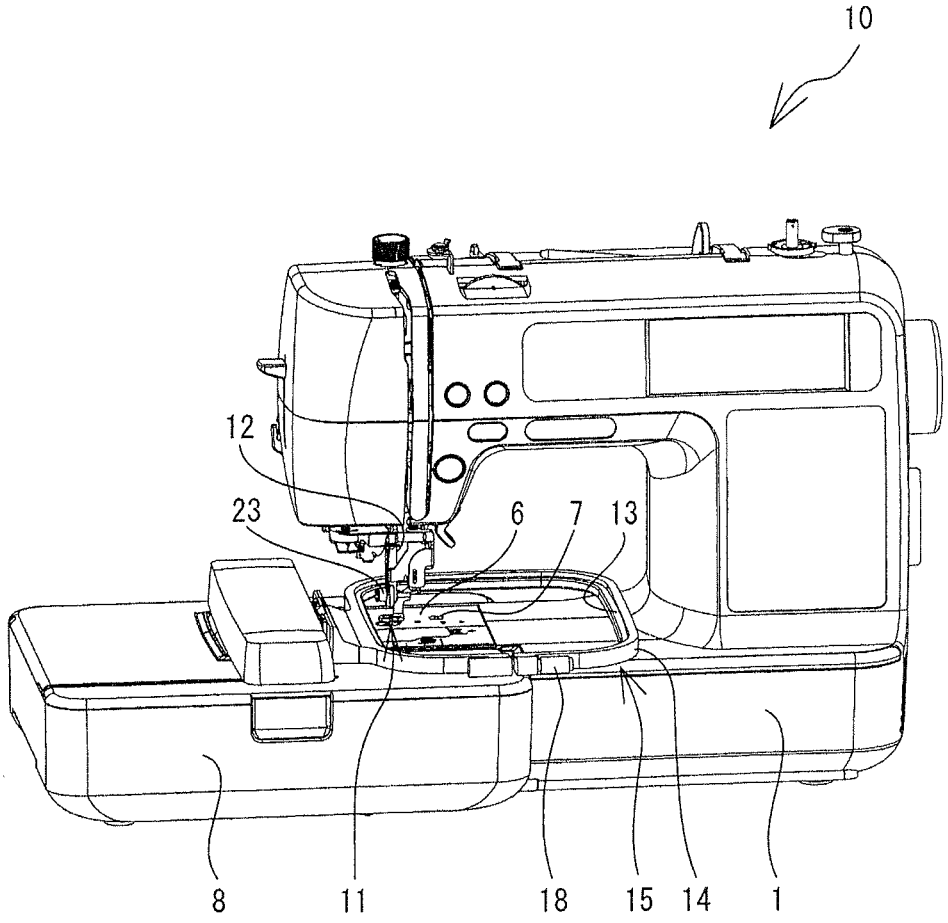
FIG. 6 is a perspective view of a sewing machine 10.

A method for using the screw tightening tool 50 to tighten the presser foot screw 23 will be described with reference to FIG. 1 and FIG. 6. The presser foot screw 23 is used to attach a presser foot 11 to a presser bar 12 of the sewing machine 10. In this case, it is assumed that the embroidery unit 8 shown in FIG. 6 and an embroidery frame 15, which will be described below, are removed from the bed 1. First, the user may insert a screw portion of the presser foot screw 23 into an insertion hole (not shown in the drawings) of the presser foot 11 and may align the screw portion with a screw hole (not shown in the drawings) of the presser bar 12. The user may rotate the presser foot screw 23 using the user's finger tips as required so as to slightly tighten the presser foot screw 23. After that, the user may hold the screw tightening tool 50 in a posture such that an extending direction of the case body 30 is parallel with the horizontal direction. The user may engage the bit portion 76 positioned in the first position with a groove portion (not shown in the drawings) of a head portion of the presser foot screw 23. At this time, the center line 38A (refer to FIG. 2) is congruent with an axis line of the presser foot screw 23. The user may rotate the case body 30 around the center line 38A while applying a force to the upper end portion and the lower end portion of the case body 30. In this way, the user may firmly tighten the presser foot screw 23 and fix the presser foot 11 to the presser bar 12. When the user loosens the presser foot screw 23, the user needs only to perform the above-described operation in reverse.

When the user tightens or loosens the presser foot screw 23, the screw tightening tool 50 has the posture in which the extending direction of the case body 30 is parallel with the horizontal direction. Thus, the screw tightening tool 50 has a posture in which the case body 30 is long in the horizontal direction, and the bit portion 76 is oriented in a direction parallel with the horizontal direction. Although the presser foot screw 23 is positioned relatively closely to a needle plate 6, which will be described below, in a height direction, the user may easily tighten or loosen the presser foot screw 23 using the screw tightening tool 50.

A case in which the needle plate screw 7 is loosened using the screw tightening tool 50 will be described with reference to FIG. 4 and FIG. 6. In a case where the user regularly cleans the inside of the bed 1, the user may need to remove the needle plate 6 from the bed 1. The needle plate screw 7 fixes the needle plate 6 to the bed 1. Therefore, the user may need to loosen the needle plate screw 7. As component parts of the sewing machine 10 are arranged on the upper side of the needle plate screw 7, a space may be limited in the height direction. When the user uses the screw tightening tool 50 in a state in which the tool member 90 is in the first position, the extending direction of the case body 30 is the height direction. When the user uses the screw tightening tool 50 in a state in which the tool member 90 is in the second position, a direction orthogonal to the extending direction of the case body 30 is the height direction. Therefore, when the user loosens the needle plate screw 7 using the screw tightening tool 50, it is desirable that the tool member 90 be positioned in the second position. The user may rotate the tool member 90 in the normal rotational direction so as to switch the position of the tool member 90 from the first position to the second position. In this case, the locking portion 46 may slide over the protruding portion 157 and then further slide over one of the protruding portions 154 so as to engage with the second lock portion 152.

The user may hold the screw tightening tool 50 so that the screw tightening tool 50 has the posture in which the extending direction of the case body 30 is parallel with the horizontal direction. The user may engage the bit portion 76 positioned in the second position with a groove portion (not shown in the drawings) of a head portion of the needle plate screw 7. The user may rotate the case body 30 around an axis of the needle plate screw 7 while applying a force to a left end portion of the case body 30. As a result, the user may easily loosen the needle plate screw 7. The user may loosen the needle plate screw 7 to an appropriate extent and then further rotate the needle plate screw 7 using the user's finger tips so as to remove the needle plate screw 7. The user may remove the needle plate 6 from the bed 1 and clean the inside of the bed 1. After that, the user may put the needle plate 6 back in the original position and lightly tighten the needle plate screw 7 using the user's finger tips. The user may firmly tighten the needle plate screw 7 using the screw tightening tool 50. In this case, the bit portion 76 positioned in the second position is further to the right than the substantially central position of the case body 30 in the left-right direction. Therefore, when the user rotates the case body 30 while applying a force to the left end portion of the case body 30, the user may firmly tighten the needle plate screw 7.

A case in which the embroidery frame screw 18 is tightened or loosened using the screw tightening tool 50 will be described with reference to FIG. 5 to FIG. 7. In this case, it is assumed that the tool member 90 is positioned in the second position. The embroidery frame 15 has a known structure in which a work cloth (not shown in the drawings) is clamped and held by an inner frame 13 and an outer frame 14. The embroidery frame 15 may be removably attached to the embroidery unit 8 shown in FIG. 6. The embroidery frame screw 18 is provided in the outer frame 14. The embroidery frame screw 18 may adjust a size of the outer frame 14. When the user holds the work cloth using the embroidery frame 15, the user may firstly loosen the embroidery frame screw 18. After that, the user may clamp the work cloth between the inner frame 13 and the outer frame 14. In this state, the user may hold the embroidery frame screw 18 using the user's finger tips so as to tighten the embroidery frame screw 18 to an appropriate extent. After that, the user may securely tighten the embroidery frame screw 18 using the screw tightening tool 50.

In order to tighten the embroidery frame screw 18 using the screw tightening tool 50, it is desirable that the tool member 90 be positioned in the third position. The user may rotate the tool member 90 in the normal rotational direction so as to switch the position of the tool member 90 from the second position to the third position. In this case, the locking portion 46 may slide over one of the protruding portions 154 and then further slide over the protruding portion 159 so as to engage with the third lock portion 153. When the tool member 90 is positioned in the third position, the bit portion 76 is positioned inside the cylindrical hole 38B and is oriented to the left direction in which the center line 38A extends.

Figure 7:
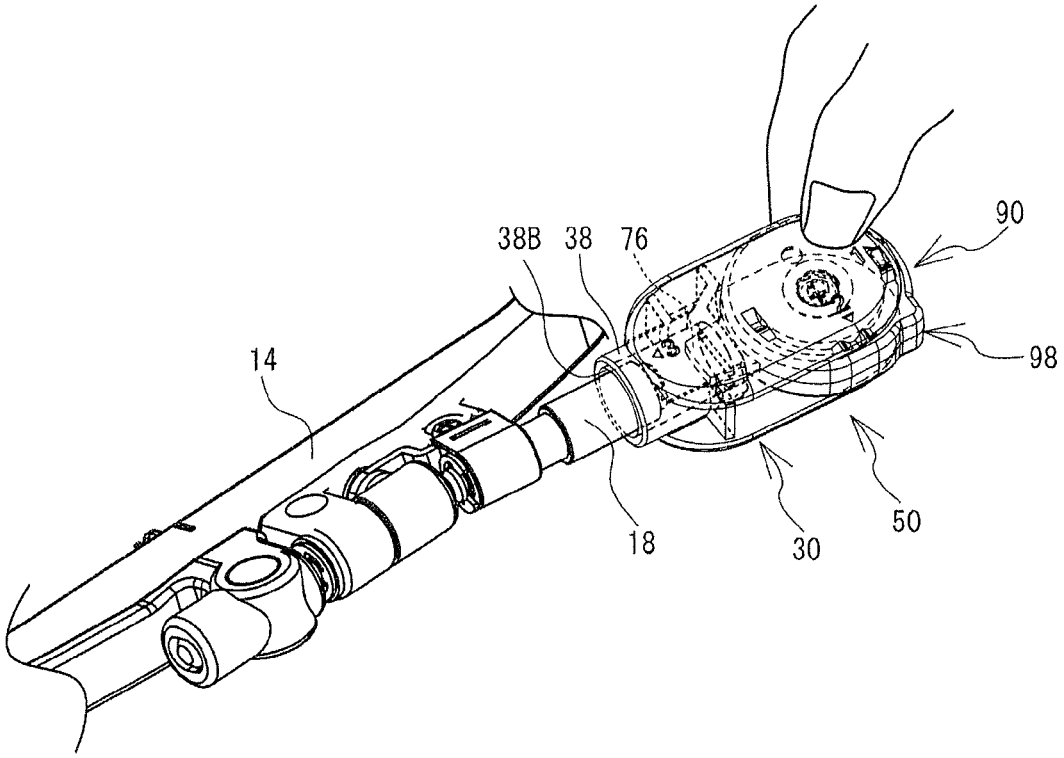
FIG. 7 is a perspective view showing an operation of tightening or loosening an embroidery frame screw 18 using the screw tightening tool 50.

The user may insert the head portion of the embroidery frame screw 18 into the cylindrical hole 38B of the guide portion 38 of the screw tightening tool 50, as shown in FIG. 7. As a result, a groove portion (not shown in the drawings) of the head portion of the embroidery frame screw 18 may engage with the bit portion 76 positioned at the third position. In this case, the center line 38A (refer to FIG. 2) is congruent with an axis line of the embroidery frame screw 18. After that, the user may rotate the case body 30 around an axis of the embroidery frame screw 18 while applying a force to the upper and lower end portions of the case body 30. As a result, the user may firmly tighten the embroidery frame screw 18.

The head portion of the embroidery frame screw 18 may be inserted into the cylindrical hole 38B of the guide portion 38 of the screw tightening tool 50. In some cases, the user may release and regrip the screw tightening tool 50 in order to rotate the embroidery frame screw 18 a plurality of times. Even in these cases, the screw tightening tool 50 can inhibit the bit portion 76 from coming out of the groove portion of the head portion of the embroidery frame screw 18. When the user removes the work cloth from the embroidery frame 15, the user only needs to perform an operation so as to loosen the embroidery frame screw 18 in the same manner as described above.

After finishing using the screw tightening tool 50, the user may store the screw tightening tool 50 in a tool box (not shown in the drawings), etc. with the tool member 90 positioned in the third position. The bit portion 76 positioned in the third position is positioned inside the case body 30. Thus, the user may store the screw tightening tool 50 in the tool box, etc. in a compact manner.

As described above, the tool member 90 is rotatably supported by the case body 30. As a result, the tool member 90 may rotate around the center line 44 and may switch the position thereof among the first position, the second position, and the third position. Thus, the user may switch the position of the tool member 90, namely, the position of the bit portion 76 in accordance with the position of the screw. When the tool member 90 is in the third position, the user may insert the head portion of the embroidery frame screw 18 into the cylindrical hole 38B of the guide portion 38 of the case body 30. In this state, the user may tighten or loosen the embroidery frame screw 18. In some cases, the user may release and regrip the screw tightening tool 50 in order to rotate the embroidery frame screw 18 a plurality of times. Even in these cases, the screw tightening tool 50 can inhibit the bit portion 76 from coming out from the groove portion of the head portion of the embroidery frame screw 18.

When the tool member 90 is positioned in one of the first position and the third position, the screw tightening tool 50 rotates around the center line 38A when the screw tightening tool 50 tightens or loosens the screw. The center line 38A extends in the extending direction of the case body 30. Therefore, the user may securely grip and easily rotate the screw tightening tool 50. The center line 38A is orthogonal to the center line 44 of the convex portion 34 and the recessed portion 33. Therefore, when the tool member 90 is in the third position, the bit portion 76 is arranged inside the guide portion 38 so as to be able to engage with the head portion of the screw.

As in the case in which the needle plate screw 7 is loosened or tightened, there is a location in which a space is limited in the height direction. Even in such a case, when the tool member 90 is positioned in the second position, the user may easily use the screw tightening tool 50. The bit portion 76 positioned in the second position is further to the right than the substantially central position of the case body 30 in the left-right direction. Therefore, by applying a force to the left end portion of the case body 30 so as to cause the case body 30 to rotate, the user may tighten the screw with a larger tightening torque compared with a case in which the tool member 90 is positioned in one of the first position and the third position.

The user may switch the position of the tool member 90 from the third position to the second position by hooking the convex portion 98 with the user's finger. Thus, the user may easily switch the position of the tool member 90 from the third position.

When the tool member 90 is positioned respectively in the first position, the second position, and the third position, the first lock portion 151, the second lock portion 152, and the third lock portion 153 respectively lock the locking portion 46. Thus, the tool member 90 does not freely rotate. The screw tightening tool 50 can improve usability.

The first mark portion 41, the second mark portion 42, and the third mark portion 43 are provided on the front surface 32B of the side wall portion 32. Thus, the user may easily recognize positions to which the position of the tool member 90 may be switched.

The guide portion 38 does not have to be integrally formed with the side wall portions 31 and 32 and the bridge portion 35. A guide portion may be removably attached to the bridge portion 35, for example. In this case, it is sufficient to prepare various guide portions corresponding to types of the screw. The user may tighten or loosen various types of the screw by selecting an appropriate guide portion and attaching the guide portion to a case body. The guide portion 38 need not necessarily be the cylindrical shape, and may have a rectangular cylindrical shape.

The shape of the convex portion 98 is not limited to the shape indicated in the above-described embodiment. Two or more of the convex portions 98 may be provided.

The first mark portion 41, the second mark portion 42, and the third mark portion 43 are not necessarily the recessed portions formed on the front surface 32B. The first mark portion, the second mark portion, and the third mark portion may be convex portions protruding from the front surface 32B. The first mark portion, the second mark portion, and the third mark portion may be stickers that are adhered to the front surface 32B. The first mark portion, the second mark portion, and the third mark portion may be printed on the front surface 32B.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A screw tightening tool comprising:

a case body including a first wall portion, a second wall portion, and a guide portion, the first wall portion and the second wall portion being opposed to each other with a specified gap, the guide portion being configured such that a head portion of a screw is inserted therein, the guide portion having a substantially cylindrical shape and protruding to a first direction from the specified gap, the first direction being orthogonal to an opposition direction, the opposition direction being a direction in which the first wall portion and the second wall portion are opposed to each other;

a tool member including a base portion and an engaging portion, the base portion being provided between the first wall portion and the second wall portion, the base portion having a substantially circular shape and having an axis line that is parallel with the opposition direction, the engaging portion protruding from the base portion to a direction that is orthogonal to the opposition direction, a bit portion that is configured to engage with the head portion being provided on a leading end of the engaging portion; and a locking mechanism including a groove portion and a case body locking portion, the groove portion being provided in a surface portion of the base portion, the surface portion being opposed to the first wall portion, the groove portion extending in a substantially circular arc around the axis line, the case body locking portion protruding from the first wall portion toward the second wall portion, a leading end of the case body locking portion being arranged inside the groove portion, wherein:

the case body rotatably supports, between the first wall portion and the second wall portion, the base portion such that the base portion rotates around the axis line, a rotation position of the tool member switches at least among a first position, a second position, and a third position in accordance with a rotation of the base portion, the first position being a rotation position in which the bit portion protrudes to an outside of the case body, the second position being a rotation position in which the bit portion protrudes to the outside of the case body and that is different from the first position, the third position being a rotation position in which the case body houses the bit portion, and the bit portion being configured to, in the third position, engage with the head portion inserted in the guide portion, the leading end of the case body locking portion slides relative to the base portion inside the groove portion in accordance with the rotation of the base portion, and the locking mechanism includes a first lock portion, a second lock portion, and a third lock portion, the first lock portion, the second lock portion, and the third lock portion being provided in the groove portion, the first lock portion locking the leading end of the case body locking portion when the tool member is in the first position, the second lock portion locking the leading end of the case body locking portion when the tool member is in the second position, the third lock portion locking the leading end of the case body locking portion when the tool member is in the third position.

2. The screw tightening tool according to claim 1, wherein:

the bit portion is configured to be oriented to the first direction when the tool member is in the third position, the first direction being parallel with an insertion direction of the head portion into the guide portion, the bit portion is configured to be oriented to a second direction when the tool member is in the second position, the second direction being a direction orthogonal to the first direction and to the opposition direction, and the bit portion is configured to be oriented to a third direction when the tool member is in the first position, the third direction being a direction opposite to the first direction.

3. The screw tightening tool according to claim 1, wherein:

the tool member includes an operation portion, the operation portion being configured to protrude to the outside of the case body at least when the tool member is in the first position.

4. The screw tightening tool according to claim 1, wherein:

the case body includes, on an outer surface of the case body, a mark indicating the first position, a mark indicating the second position, and a mark indicating the third position.

5. The screw tightening tool according to claim 1, wherein at least one of the first lock portion, the second lock portion, and the third lock portion includes a pair of contact portions, the pair of contact portions being arranged side by side with a gap in the extending direction of the groove portion, one of the contact portions contacting the leading end of the case body locking portion when the leading end of the case body locking portion is disposed between the pair of contact portions, one of the contact portions contacting the leading end of the case body locking portion when the leading end of the case body locking portion is disposed between the pair of contact portions.

* * * * *